United States Patent [19]

Ogawa

[11] Patent Number: 4,746,841

[45] Date of Patent: May 24, 1988

[54] FLUORESCENT LAMP OPERATING DEVICE

[75] Inventor: Soichiro Ogawa, Tokyo, Japan

[73] Assignee: Hitachi, Ltd., Tokyo, Japan

[21] Appl. No.: 883,048

[22] Filed: Jul. 8, 1986

[30] Foreign Application Priority Data

Jul. 10, 1985 [JP] Japan ..... 60-150188

[51] Int. Cl.[4] ..... H05B 41/18; H05B 36/17

[52] U.S. Cl. ..... 315/102; 315/106; 315/107; 315/225; 315/227 R; 315/245; 315/276; 315/DIG. 5; 315/DIG. 7

[58] Field of Search ..... 315/DIG. 7, DIG. 5, 315/94, 102, 106, 107, 225, 226, 227 R, 99, 101, 276, 245

[56] References Cited

U.S. PATENT DOCUMENTS

| | | | |
|---|---|---|---|
| 3,978,369 | 8/1976 | Imaizumi et al. | 315/DIG. 7 |
| 4,158,793 | 6/1979 | Lewis | 315/101 |
| 4,559,478 | 12/1985 | Filler et al. | 315/106 X |
| 4,588,924 | 5/1986 | Luursema et al. | 315/107 |

FOREIGN PATENT DOCUMENTS

| | | | |
|---|---|---|---|
| 59-132594 | 7/1984 | Japan | 315/DIG. 7 |

*Primary Examiner*—David K. Moore
*Assistant Examiner*—Mark R. Powell
*Attorney, Agent, or Firm*—Antonelli, Terry & Wands

[57] ABSTRACT

A fluorescent lamp operating device having a power supply, a circuit for converting the output power from the power supply into a high-frequency power, a lighting circuit connected to a secondary side of a transformer of the high-frequency power converter circuit to light a fluorescent lamp, a circuit for preheating the filament of the fluorescent lamp, a switch circuit including diodes and at least one transistor connected in series with the fluorescent lamp in the lighting circuit, and a control circuit for turning off the transistor for a predetermined period when the power supply is turned on thereby turning off the lighting circuit to actuate the preheating circuit during this period. The control circuit turns on the transistor at the end of the predetermined period to thereby actuate the lighting circuit.

8 Claims, 3 Drawing Sheets

FLUORESCENT LAMP OPERATING DEVICE

BACKGROUND OF THE INVENTION

The present invention relates to a high-frequency inverter for fluorescent lamps, or, more particularly to a fluorescent lamp operating device which improves the lighting on-off cycle life of fluorescent lamps significantly and is suitable for being equipped with a dimming function at the same time.

There have been made available various conventional fluorescent lamp operating devices which have a function equivalent to that of an operating device used for turning on a fluorescent lamp after preheating such as a fluorescent lamp of glow starting type. With respect to one of them, the operating device disclosed in Japanese Patent Laid-Open Publication (JP-A) No. 59-132594 comprises means for turning off the device after a predetermined preheating time at the time of starting by use of a saturable reactor.

In this type of operating device, however, there is no preheating and only the filament is heated with a lamp current after the lamp has been turned on. Therefore, in applications requiring free control of the lamp load, the filament temperature of the fluorescent lamp decreases with the decrease of the lamp current, thereby shortening the lamp on-off cycle life. Another disadvantage of this type of operating device is a high cost due to the combination of a saturable reactor and a capacitor.

A dimming circuit which is separately required for providing a dimming function renders the cost even higher and reduces the reliability.

SUMMARY OF THE INVENTION

Accordingly, it is an object of the present invention to provide a fluorescent lamp operating device of high frequency oscillation for fluorescent lamps which long endures the on-off operations and is capable of being equipped with a dimming function at low cost.

If the filament is not preheated when the fluorescent lamp is started, i.e., the fluorescent lamp starts by cold cathode, leading to a greatly reduced on-off cycle life. In the dimming operation, on the other hand, the life of the fluorescent lamp shortens unless the filament always remains preheated while the lamp is on. In order to solve these two problems at the same time, three independent circuits including two normally preheating circuits and a lamp lighting circuit are required to be provided on the secondary side of a transformer, and functions to turn off the lighting circuit temporarily and to repeat the turning on and off of the lighting circuit when necessary, are required.

According to the present invention, in order to satisfy the above-mentioned requirements, there is provided a low-cost, reliable fluorescent lamp operating device comprising a lighting circuit, a switch circuit including diodes and at least one transistor connected in series with the lighting circuit, and a timer part for turning off the lighting circuit for a predetermined period by using such a transient phenomenon of an R-C time constant circuit that a voltage of the medium point of the time constant circuit changes from 0 V to the source voltage or from the source voltage to 0 V, whereby dimming operation is performed by controlling the duty signal of a repetition cycle to the transistor.

DESCRIPTION OF THE PREFERRED EMBODIMENTS

Figure 1:
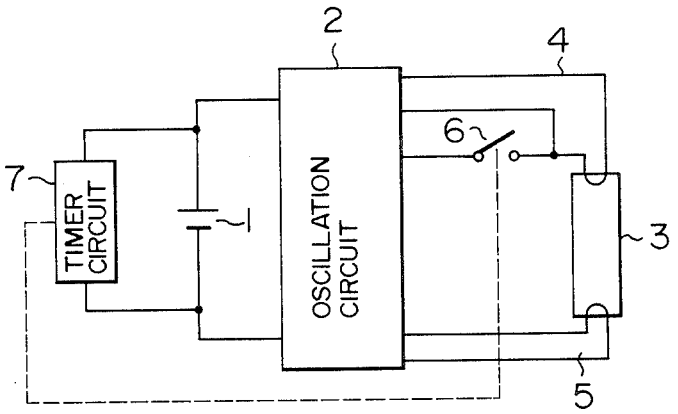
FIG. 1 is a diagram illustrating a basic circuit configuration of a fluorescent lamp operating device according to the present invention.

A basic circuit configuration of the fluorescent lamp operating device according to the present invention is shown in FIG. 1. Power is supplied from a direct current source 1 and converted into a high-frequency power by an oscillation circuit 2. Each filament of the fluorescent lamp 3 is heated by preheating circuits 4 and 5. A control circuit 7 for controlling a switch 6 inserted between the oscillation circuit 2 and the fluorescent lamp 3 is connected in parallel to the power supply 1. As soon as the power supply 1 is turned on, the switch 6 is opened for a predetermined length of time, and after sufficient preheating operation, the switch 6 is closed to thereby light the lamp 3. While the fluorescent lamp 3 is lit, the switch 6 may be turned on and off repeatedly at a frequency of, say, 200 Hz, thus making possible the dimming operation freely simply by changing the duty factor.

As described above, according to the present embodiment of the invention, the damage to the filament, which otherwise might be caused by the repeated on and off of the fluorescent lamp, is virtually eliminated since the lamp is operated without cold cathode starting, thus providing a low-cost, reliable fluorescent lamp lighting circuit which has a long service life on the one hand and has a dimming function which can be easily performed simply by application of a signal of repetition frequency on the other hand.

Figure 2:
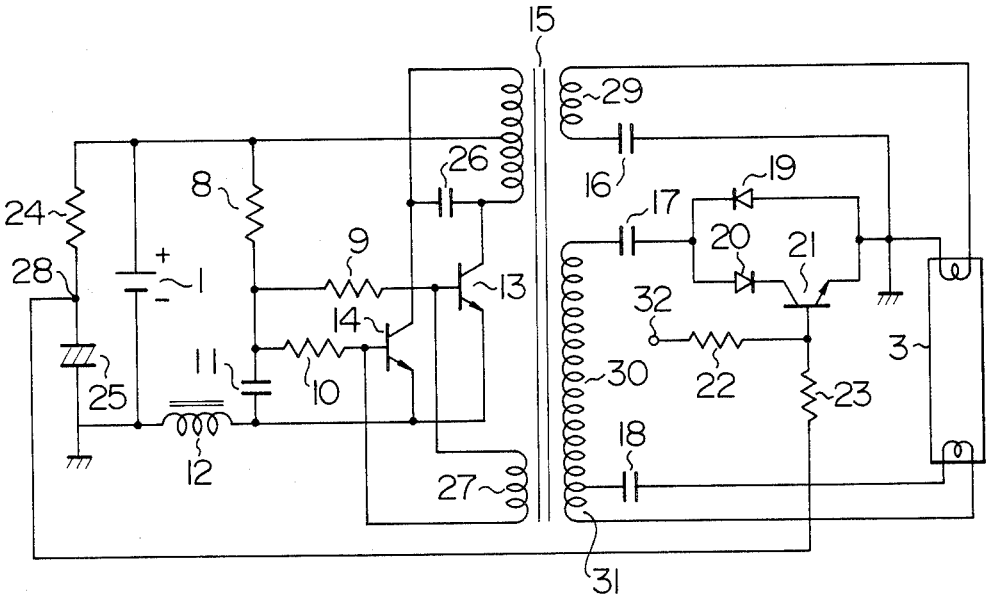
FIG. 2 is a diagram illustrating a circuit configuration of an embodiment of the present invention.

An embodiment of the present invention is shown in FIG. 2.

This lighting circuit makes up a two-component push-pull oscillation circuit. In the oscillating operation, when a power supply 1 is turned on, a base current flows through resistors 8, 9 and 10, so that one of the two transistors 13 and 14 is turned on slightly earlier than the other. Assume that the transistor 13 is turned on earlier. Current flows in the winding of a transformer 15, and by the resonance between the inductance of the primary winding of the transformer 15 and a resonance capacitor 26, a potential difference develops across winding 27 which is connected between the base electrodes of transistors 13 and 14. This potential difference causes a negative feedback to the transistor 13 and a positive feedback to the transistor 14, with the result that the transistor 13 is turned off, and the transistor 14 turned on. This operation is repeated for oscillation. The voltage thus oscillated is taken out at the secondary of the transformer 15 and is supplied to each of the preheating circuits 29, 31 and the lamp lighting circuit. When using an autotransformer as the transformer 15, primary and secondary sides thereof will be referred to as primary and secondary windings.

An explanation will now be given of the operation of the lamp lighting circuit associated with the turning on of the power supply 1. The lamp lighting circuit is turned on after being temporarily turned off by using the fact that a potential at the connection point 28 of an R-C time constant circuit of a controlling circuit including a resistor 24 and a capacitor 25 in parallel to the power supply undergoes a change between 0 V and the source voltage due to the time constant thereof. This operation will be explained more specifically below.

The secondary voltage generated in the secondary side 30 of the transformer 15 is applied through a ballast capacitor 17 thereby lighting the fluorescent lamp 3. In view of the fact that the potential at the connection point 28 of the RC time constant circuit is applied to the transistor 21 through a base resistor 23, the transistor 21 is turned off when the power supply 1 is subsequently turned on. The transistor 21 is subsequently on after a sufficient charge build-up across the capacitor 25 of the RC time constant thereby lighting the lamp 3. In the process, the preheating circuits 29, 31 begin to preheat the filament simultaneously with the turning on of the power supply, thus starting the lamp 3 by hot cathode. If the terminal 32 is supplied with a frequency or an on-off repetition signal of 200 Hz (rectangular wave) while the lamp is lit, for instance, the base current flows or ceases to flow in predetermined cycles (200 Hz) through the resistor 22, and therefore the transistor 21 is also turned on and off thereby performing the dimming of the lamp 3. The dimming rate can be controlled as desired by changing the duty factor of the on-off repetition signal. A switch part includes a diode 19 in parallel with a parallel series circuit having a diode 20 and the transistor 21. The diode 20, although not necessary for the dimming operation, is inserted to block the reverse current which flows when the transistor 21 is turned off. Capacitors 16, 18 are inserted in the preheating circuits 29, 31 for controlling the preheat current. By increasing the frequency before the lighting of the lamp 3 is increased beyond the frequency during the lighting thereof, the lamp 3 is preheated more before than after lighting thereby to lengthen the on-off cycle life of the lamp 3.

The same can be said of the dimming operation which is repetition of the lighting on-off of the lamp. Specifically, the lamp is preheated to a degree less during lighting than during extinction, thus lengthening the service life of the lamp.

Figure 3:
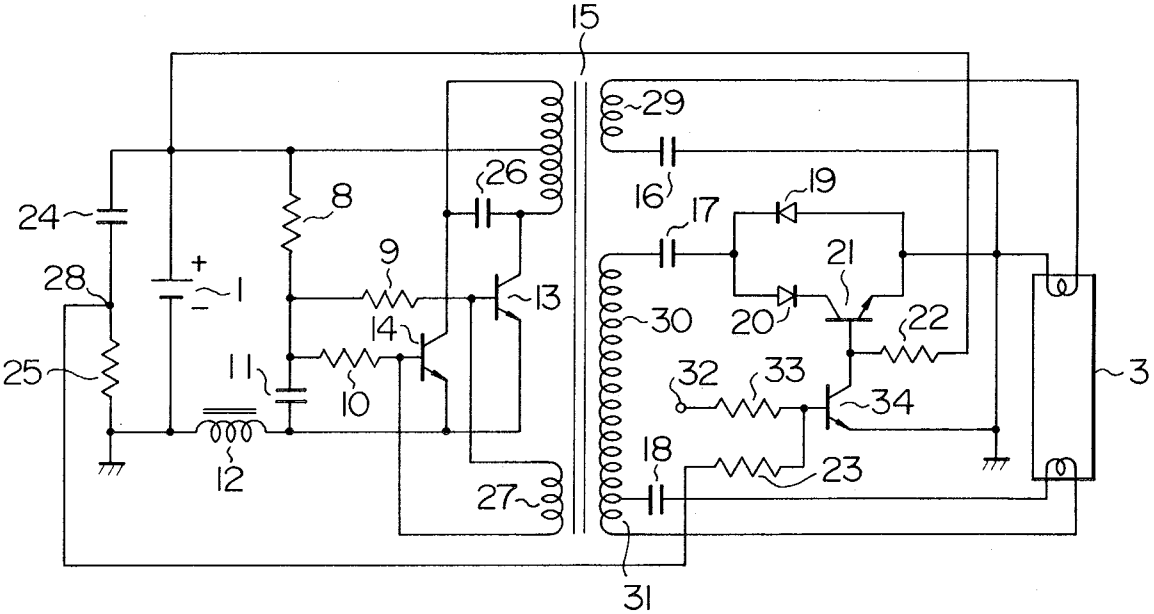
FIG. 3 illustrates a modification of the circuit embodiment illustrated in FIG. 2 having dimming capability with a signal of small capacity.

Another embodiment is shown in FIG. 3. In this embodiment, the resistor and capacitor of the R-C time constant circuit is arranged in reverse relation with the embodiment of FIG. 2, so that the potential at the RC connection point 28 changes between the source voltage and 0 V. the switch part is constituted by a transistor reversing action circuit. In operation, the transistor 34 is kept on for some period after turning on of the power supply 1 by the potential of the medium point 28, and thereafter turned off. Thus, the transistor 21 changes from off to on in accordance with the changes of the transistor 34, attaining the same effect as that mentioned above.

The embodiment under consideration is different from the circuit of FIG. 2 in that in the circuit of FIG. 2, since a duty signal is applied directly to the transistor 21, the signal is required to be one for a large output because this transistor 21 is a high voltage type transistor having a small amplification factor $h_{fe}$. In the circuit of FIG. 3, by comparison, the transistor 34 has a breakdown voltage equal to a source voltage at most (about 12 V or 20 V) and may have a high amplification factor $h_{fe}$, thereby eliminating the requirement for the signal for a large output. This is considered an advantage since a rectangular wave signal is generally produced by an IC or TTL which is difficult to achieve a large capacity.

Figure 4:
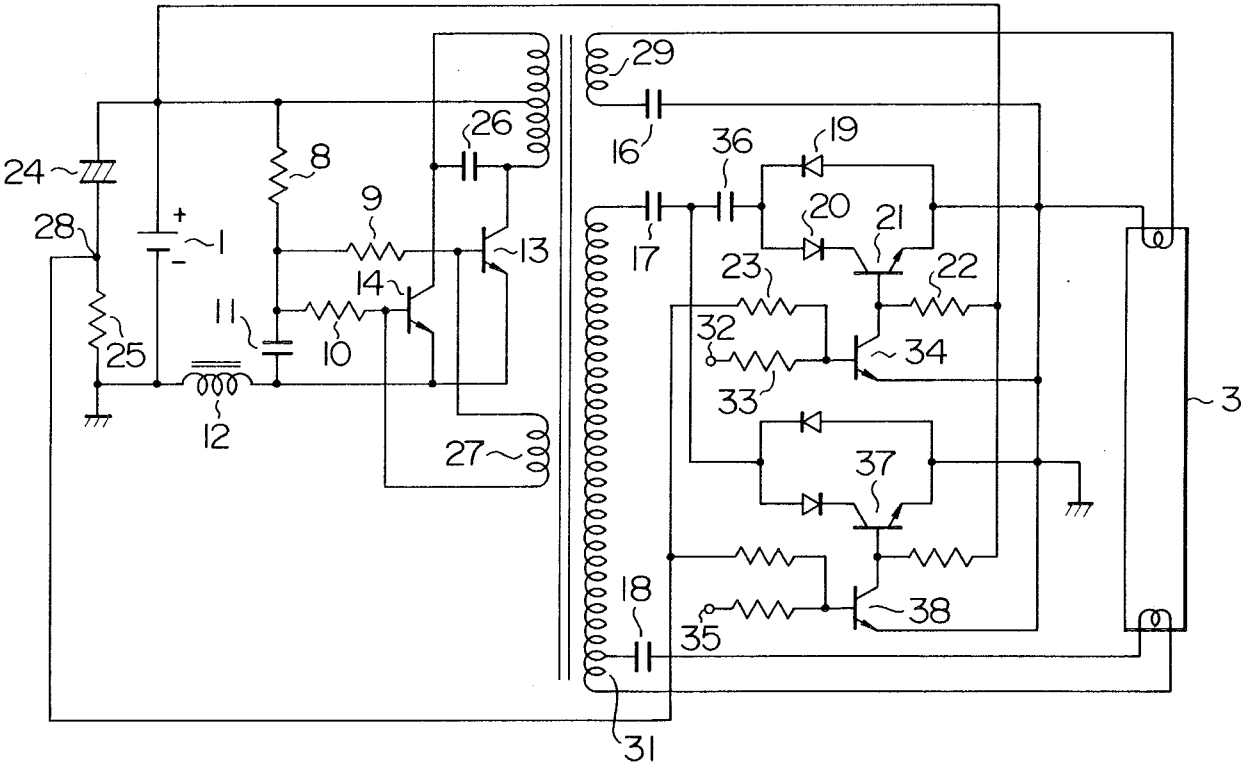
FIG. 4 illustrates a circuit configuration of another embodiment comprising a plurality of switches, unlike the circuit of FIG. 3 which uses only one such switch, for dual functions of step dimming and continuous dimming.

FIG. 4 shows still another embodiment, which has a feature in that both the step dimming and continuous dimming are possible. The embodiment of FIG. 4 further includes, in addition to the embodiment of FIG. 3, a capacitor 36 in series with the capacitor 17, a transistor 37 in parallel with a serial connection of the capacitor 36 and transistor 21, and a transistor 38 whose collector is connected to a base of the transistor 37 and a power supply 1 and a base is connected to the point 28 and a terminal 35 for receiving a potential of the same level as the source voltage. In FIG. 4, with the turning on of the power supply 1, the transistor 38 is changed from on state, when the source voltage is not applied to terminal 35, to off state thereby turning on the transistor 37, so that a lamp current flows from the capacitor 17 into the transistor 37 to light the lamp. In this state, if a potential of the same level as the source voltage is applied to the terminal 35, the transistor 38 is turned on to thereby turn off the transistor 37, so that the lamp current flows from the capacitor 17 into the transistor 21 through the capacitor 36, and therefore the lamp current decreases for step dimming. It is of course possible to control the level of step dimming as desired by selecting an appropriate capacitance for the capacitor 36.

Further, in this state, if the duty signal is applied to the terminal 32, the continuous dimming is possible as in the afore-mentioned embodiments.

These switch parts may be combined in series or parallel to obtain a dimming operation with a variety of combinations of step and continuous dimmings.

It will thus be understood from the foregoing description that according to the present invention, there is provided a novel lamp lighting device in which a switch circuit having diodes and at least one transistor is inserted in series with a lamp lighting circuit, and a simple, low-cost timer circuit such as an R-C time constant circuit is used for controlling the switch circuit, thus realizing dual functions of a high durability against the turning on and off and simple dimming operation of the lamp, which is highly reliable and low in cost as compared with conventional lamp lighting devices having the dimming function.

I claim:

1. A fluorescent lamp operating device comprising:

a power supply;

a high-frequency power converter circuit for converting the output power from said power supply into a high frequency power and including a transformer;

a lighting circuit operatively connected to a secondary side of said transformer for lighting a fluorescent lamp;

a preheating circuit operatively connected to said secondary side of said transformer for continuously preheating the filament of said fluorescent lamp while said power supply is turned on;

a switch circuit including diodes and a transistor circuit operatively inter-connected, said switch circuit being provided in said lighting circuit and being connected in series with said fluorescent lamp; and a control circuit for turning off said lighting circuit for a predetermined period by first turning off said transistor circuit during said predetermined period in response to the turn-on of said power supply thereby actuating said preheating circuit to preheat the filament during said predetermined period prior to actuating said lighting circuit, said control circuit turning on said transistor circuit at the end of said predetermined period thereby actuating said lighting circuit.

2. A fluorescent lamp operating device according to claim 1, wherein said control circuit includes a time constant circuit including a resistor and a capacitor connected in series, wherein the potential at the connection point of said resistor and said capacitor of the time constant circuit is applied to said transistor circuit as a control signal for controlling the on-off state of said transistor circuit.

3. A fluorescent lamp operating device according to claim 2, wherein said switch circuit includes a terminal for receiving and applying a periodic pulse signal to a control electrode of said transistor circuit for performing dimming function in accordance with the duty ratio of said pulse signal.

4. A fluorescent lamp operating device according to claim 2, wherein said transistor circuit includes one transistor whose base electrode is coupled to said connection point.

5. A fluorescent lamp operating device according to claim 2, wherein said transistor circuit includes first and second transistors, said second transistor has a base electrode coupled to said connection point and a collector-emitter circuit connected to the base of said first transistor, and wherein said first transistor is operatively connected such that at the end of said predetermined period, subsequent to the power source turn-on, said second transistor is turned off thereby turning on said first transistor to actuate said lighting circuit.

6. A fluorescent lamp operating device according to claim 5, wherein said switch circuit includes a terminal for receiving and applying a periodic pulse signal to the base electrode of said second transistor for controllably performing a dimming function in accordance with the duty ratio of said periodic pulse signal.

7. A fluorescent lamp operating device according to claim 2, wherein said switch circuit includes a serial connection of a capacitor and a first transistor, a second transistor having a base electrode coupled to said connection point and a collector-emitter circuit connected to the base of said first transistor, a third transistor having a collector-emitter circuit connected in parallel with said serial connection, and a fourth transistor having a base electrode coupled to said connection point and to a first terminal for receiving a power supply voltage and having a collector-emitter circuit connected to the base electrode of said third transistor, wherein, subsequent to turning on the power source, and when said power supply voltage is not applied to said first terminal, said fourth transistor is turned off thereby turning on said third transistor which actuates said lighting circuit at the end of said predetermined period, and, when said power supply voltage is applied to said first terminal, said third transistor is turned off thereby turning on said first transistor and thereby actuating said lighting circuit.

8. A fluorescent lamp operating device according to claim 7, wherein said switch circuit further includes a terminal for receiving and applying a periodic pulse signal to the base electrode of said second transistor for performing a controllable dimming function in accordance with the duty ratio of said pulse signal.

* * * * *